US007073470B2

(12) United States Patent
Horiuchi et al.

(10) Patent No.: US 7,073,470 B2
(45) Date of Patent: Jul. 11, 2006

(54) VARIABLE VALVE APPARATUS OF INTERNAL COMBUSTION ENGINE

(75) Inventors: Manabu Horiuchi, Kawasaki (JP); Koichi Kawamoto, Kawasaki (JP); Satoshi Nakajima, Kawasaki (JP); Masahiro Maekawa, Minato-ku (JP); Yasunori Daigo, Minato-ku (JP)

(73) Assignee: Mitsubishi Fuso Truck and Bus Corporation (JP)

( * ) Notice: Subject to any disclaimer, the term of this patent is extended or adjusted under 35 U.S.C. 154(b) by 0 days.

(21) Appl. No.: 11/084,721

(22) Filed: Mar. 18, 2005

(65) Prior Publication Data

US 2005/0224027 A1 Oct. 13, 2005

(30) Foreign Application Priority Data

Mar. 19, 2004 (JP) ..... 2004-079539

(51) Int. Cl.
*F01L 1/34* (2006.01)

(52) U.S. Cl. ..... 123/90.16; 123/90.15; 123/90.17; 123/90.31

(58) Field of Classification Search ..... 123/90.16
See application file for complete search history.

(56) References Cited

U.S. PATENT DOCUMENTS 6,422,187 B1 * 7/2002 Fischer et al. ..... 123/90.16
6,786,185 B1 * 9/2004 Pierik ..... 123/90.16

* cited by examiner

*Primary Examiner*—Thomas Denion
*Assistant Examiner*—Kyle M. Riddle
(74) *Attorney, Agent, or Firm*—Rossi, Kimms & McDowell, LLP

(57) ABSTRACT

A variable valve apparatus comprises a rocker shaft having an eccentric shaft rendered eccentric, a cam provided below the rocker shaft and rotationally driven, a support shaft disposed at a height equal to the rocker shaft, a first arm rockingly supported by the rocker shaft and capable of driving a valve, a second arm rockingly supported by the eccentric shaft and driven by the cam, and a third arm rockingly supported by the support shaft and displaced by rocking of the second arm for driving the first arm, and turns the rocker shaft in the direction of R2 to continuously change the valve opening timing and lift amount of the valve.

16 Claims, 9 Drawing Sheets

VARIABLE VALVE APPARATUS OF INTERNAL COMBUSTION ENGINE

CROSS REFERENCE TO RELATED APPLICATION

The entire disclosure of Japanese Patent Application No. 2004-079539 filed on Mar. 19, 2004, including specification, claims, drawings and summary, is incorporated herein by reference in its entirety.

BACKGROUND OF THE INVENTION

1. Field of the Invention

This invention relates to a variable valve apparatus of an internal combustion engine which can change the drive phases and valve lift amounts of an intake valve and an exhaust valve.

2. Description of the Related Art

Knowledge is widespread about technologies for changing the phases and lift amounts of valves of an intake and exhaust system in accordance with the operating status of an internal combustion engine, for example, an automobile engine for the purposes of dealing with emission gases and reducing fuel consumption. A vane type variable phase valve apparatus for continuously changing a cam phase by a hydraulic force is known as a variable valve apparatus used in these technologies.

Knowledge is also abundant of a cam-switched valve apparatus which switches among a plurality of cams in accordance with the operating status of an internal combustion engine to adapt the drive phases and lift amounts of valves to the operating status.

Knowledge is also ample about a mechanical continuous variable valve apparatus which can be arranged to change the drive phases and lift amounts of valves by use of gears driven by stepping motors, intermediate levers and return springs (see, for example, Japanese Patent No. 3245492).

A vane type variable phase valve apparatus can shift the drive phase of a valve by changing the position of a vane, but cannot change the lift amount of the valve.

A cam-switched valve apparatus or a mechanical continuous variable valve apparatus, on the other hand, can shift the lift amount and phase of a valve. However, the cam-switched valve apparatus requires a plurality of cams, thus using many components and involving a complicated structure. The mechanical continuous variable valve apparatus needs, separately, a mechanism for changing the lift amount and a mechanism for shifting the phase, thus resulting in a complicated structure and large dimensions.

With a conventional ordinary continuous phase variable valve apparatus, when the valve closing timing of the intake valve is retarded, the valve opening start timing is also retarded. Thus, a valve overlap of the intake valve and the exhaust valve is decreased or lost, thereby posing the problem that poor fuel economy due to a pumping loss occurs.

In addition, these variable valve apparatuses often have a large height on account of their structure. Since the variable valve apparatus is installed above the cylinder head of an engine, the height of the entire engine is often great. Because of its complicated structure, moreover, a high accuracy of position is required of components to be operated in interlocked relationship. Their designing is so difficult that setting of desired valve lift characteristics has not been easy.

SUMMARY OF THE INVENTION

The present invention has been accomplished in light of the above-described problems. It is an object of the present invention to provide a variable valve apparatus which can obtain desired valve lift characteristics and limit the height of the entire apparatus by adopting a relatively simple configuration.

A first aspect of the present invention, for attaining the above object, is a variable valve apparatus of an internal combustion engine, comprising:

a rocker shaft pivotally provided in an internal combustion engine, and provided with an eccentric shaft rendered eccentric;

a cam provided below the rocker shaft, and rotationally driven by a cam shaft;

a support shaft disposed at a height equal to or lower than a height of the rocker shaft;

pivoting elements for pivoting the rocker shaft; and opening and closing elements driven by the cam for opening and closing an intake valve or an exhaust valve, and wherein the opening and closing elements comprises a first arm rockingly supported by the rocker shaft, and being capable of driving the intake vale or the exhaust valve, a second arm rockingly supported by the eccentric shaft, and driven by the cam, and a third arm rockingly supported by the support shaft, and displaced by rocking of the second arm for driving the first arm.

A ninth aspect of the present invention, for attaining the above object, is a variable valve apparatus of an internal combustion engine, comprising:

a rocker shaft pivotally provided in an internal combustion engine;

a cam provided below the rocker shaft, and rotationally driven by a cam shaft;

a support shaft disposed at a height equal to or lower than the height of the rocker shaft;

pivoting elements for pivoting the rocker shaft; and opening and closing elements driven by the cam for opening and closing an intake valve or an exhaust valve, and wherein the opening and closing elements comprises a first arm rockingly supported by the rocker shaft, and being capable of driving the intake vale or the exhaust valve, a second arm rockingly supported by a connecting member provided in the rocker shaft, and driven by the cam, and a third arm rockingly supported by the support shaft, and displaced by rocking of the second arm for driving the first arm.

A second or tenth aspect of the present invention, for attaining the above object, is the above variable valve apparatus, wherein the eccentric shaft or the connecting member is displaced in a circumferential direction of the rocker shaft by pivoting of the rocker shaft by the pivoting elements.

In this variable valve apparatus, when the rocker shaft is pivoted by the pivoting elements, the position of the eccentric shaft or the connecting member is displaced in the circumferential direction of the rocker shaft. The displacement of the eccentric shaft or the connecting member is the displacement of the position of the center of rocking of the second arm. In accordance with this displacement, the point of contact of the second arm with the cam is also displaced in the outer peripheral direction of the cam. Thus, in accordance with the position of the eccentric shaft or the connecting member, the rotation phase of the second arm with respect to the cam is advanced or retarded. Eventually, the drive phase of the first arm driven via the second arm and the third arm is advanced or retarded.

A third or eleventh aspect of the present invention, for attaining the above object, is the above variable valve apparatus, wherein the third arm has a first cam surface in contact with the first arm, and a second cam surface in contact with the second arm, and the first cam surface and the second cam surface are rocked in contact with the first arm and the second arm at a position on an opposite side of the support shaft from the rocker shaft.

A fourth or twelfth aspect of the present invention, for attaining the above object, is the above variable valve apparatus, wherein rollers are provided in the first arm and the second arm, and the rollers are brought into contact with the first cam surface and the second cam surface of the third arm.

A fifth or thirteenth aspect of the present invention, for attaining the above object, is the above variable valve apparatus, wherein the first cam surface and the second cam surface have a conversion surface portion whose distance from the center of the support shaft changes, and the conversion surface portion is composed of a flat surface.

Thus, the conversion surface portions of the first cam surface and the second cam surface of the third arm are easy to machine, and rocking of the second arm can be reliably transmitted to the first arm.

A sixth or fourteenth aspect of the present invention, for attaining the above object, is the above variable valve apparatus, wherein the conversion surface portion is composed of a convex curved surface or a concave curved surface.

A seventh, eighth, fifteenth or sixteenth aspect of the present invention, for attaining the above object, is the above variable valve apparatus, wherein the first cam surface and the second cam surface have a non-conversion surface portion whose distance from the center of the support shaft does not change in a direction of rocking of the third arm.

Thus, when the non-conversion surface portion of the first cam surface of the third arm makes contact with the first arm during rocking of the third arm, the amount of rocking of the second arm is not converted by the third arm, so that no transmission to the first arm takes place, and thus the first arm is not driven.

According to the first, second, ninth and tenth aspects of the present invention, when the rocker shaft is pivoted by the pivoting elements, the position of the eccentric shaft or the connecting member of the rocker shaft is displaced. Thus, the position of the center of rocking of the second arm rockingly supported by the eccentric shaft or the connecting member is also displaced around the axis of the rocker shaft. In accordance with the position of displacement of the center of rocking, the drive phase of the intake valve or the exhaust valve can be continuously changed. Moreover, the cam shaft supporting the cam is disposed below the rocker shaft, and the support shaft supporting the third arm is disposed at a height equal to or lower than the height of the rocker shaft. Thus, flexibility is imparted to the position of construction of the third arm functioning as a transmission cam, and the height of the entire variable valve apparatus can be kept low.

According to the third, fourth, eleventh and twelfth aspects of the present invention, the first cam surface and the second cam surface of the third arm contact the first arm and the second arm at the position on the opposite side of the support shaft from the rocker shaft. Furthermore, the contacts are made using the rollers. Thus, flexibility is imparted to the position of construction of the third arm functioning as a transmission cam, and the height of the entire variable valve apparatus can be kept low. Besides, an adequate rocking region for the third arm can be ensured in disposing the third arm.

According to the fifth and thirteenth aspects of the present invention, the conversion surface portions whose distance from the center of the support shaft changes are provided in the first cam surface and the second cam surface of the third arm, and the conversion surface portions are composed of flat surfaces. Thus, the amount of rocking of the second arm can be converted by the third arm and reliably transmitted to the first arm, and machining of the cam is facilitated.

According to the sixth and fourteenth aspects of the present invention, changes in the shapes of the conversion surface portions of the first cam surface and the second cam surface of the third arm functioning as a transmission cam can result in changes in the valve lift characteristics such as the lift amount and the lift speed. Consequently, it becomes possible to select optimum valve lift characteristics suitable for the properties of the internal combustion engine. Changes in the valve lift characteristics due to changes in the shape of the conversion surface portion can be made independently of changes in the valve lift characteristics, such as the lift amount and the valve opening angle, due to the displacement of the eccentric shaft. Thus, depending on a combination of such changes, diverse valve lift characteristics can be selected.

According to the seventh, eighth, fifteenth and sixteenth aspects of the present invention, the non-conversion surface portion whose distance from the center of the support shaft does not change is provided in the first cam surface and the second cam surface of the third arm. Even when the rotation phase of the second arm with respect to the cam is advanced by a predetermined angle by means of the pivoting elements, the amount of rocking nearly corresponding to the predetermined angle from the start of rocking of the second arm can be cancelled out by the non-conversion surface portion. Thus, the timing of initiating valve opening can be rendered nearly identical, regardless of the valve lift amount.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

A variable valve apparatus according to the present invention will now be described in detail by embodiments with reference to FIGS. 1 to 8, which in no way limit the invention.

Embodiment 1

FIGS. 1 to 7 show examples of embodiments of a variable valve apparatus according to the present invention.

Figure 1:
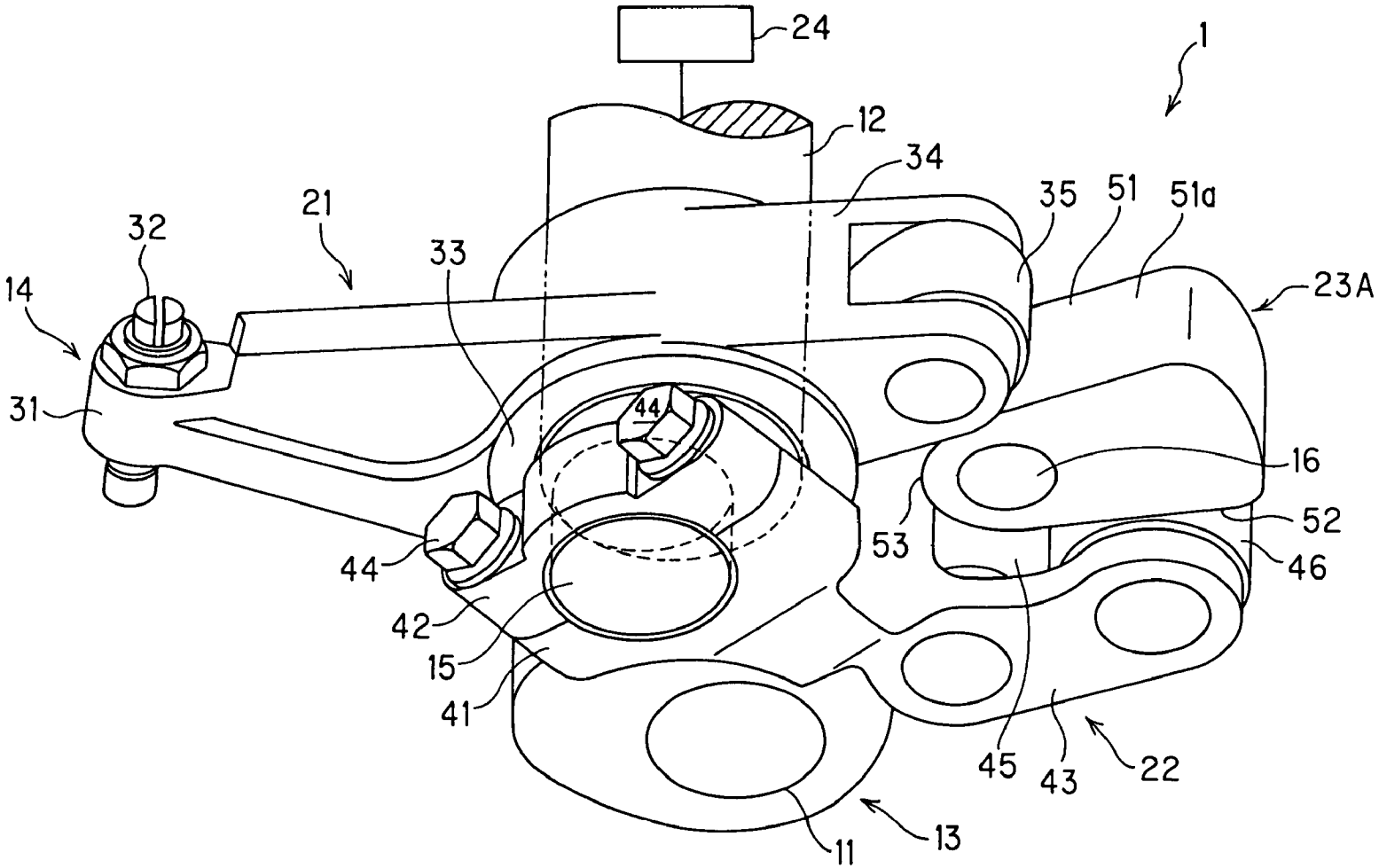
FIG. 1 is a perspective view showing an example of an embodiment of a variable valve apparatus according to the present invention.
Figure 2:
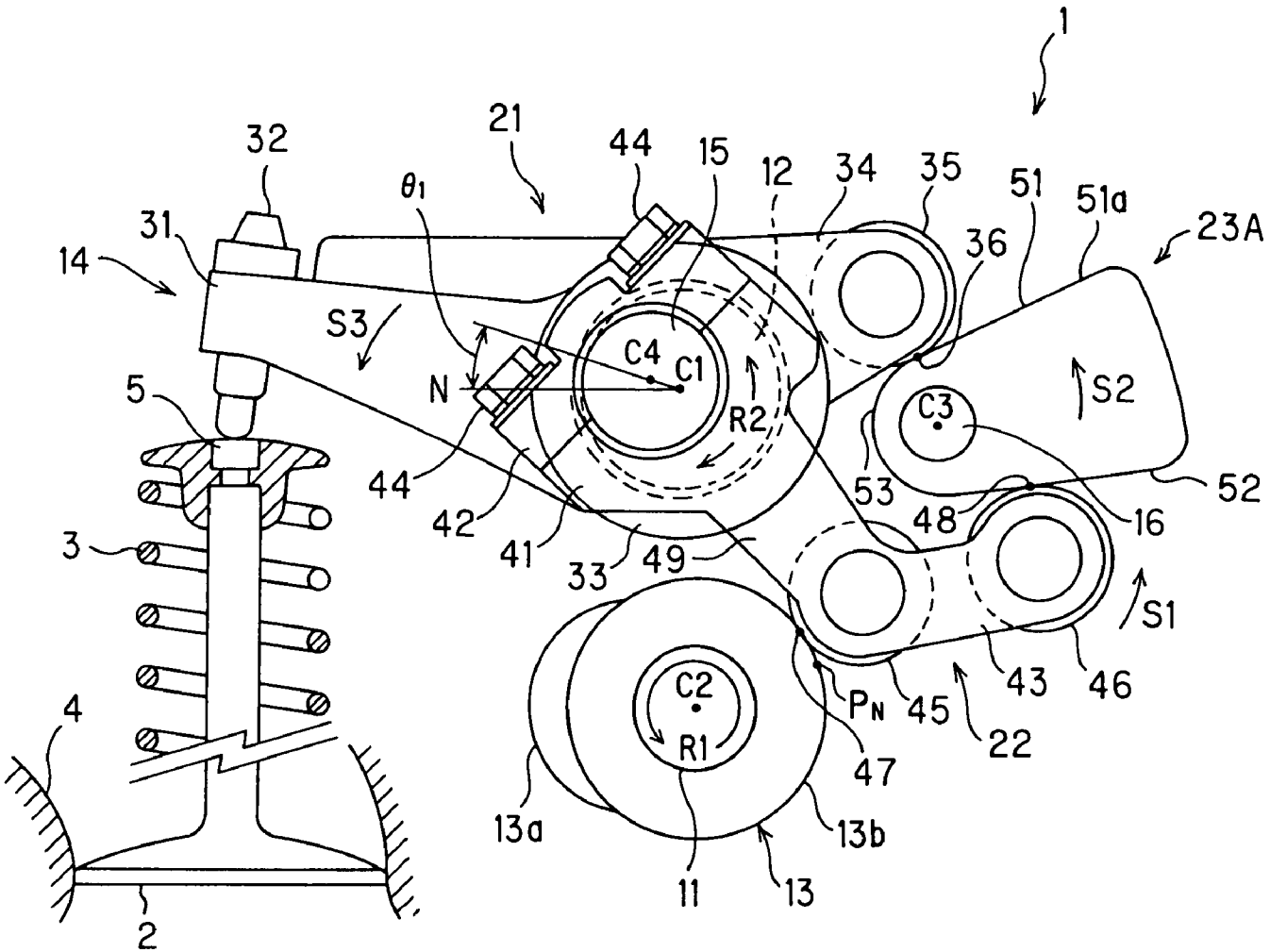
FIG. 2 is a view at the time of valve closing when the phase of the cam angle of the variable valve apparatus shown in FIG. 1 is retarded.
Figure 3:
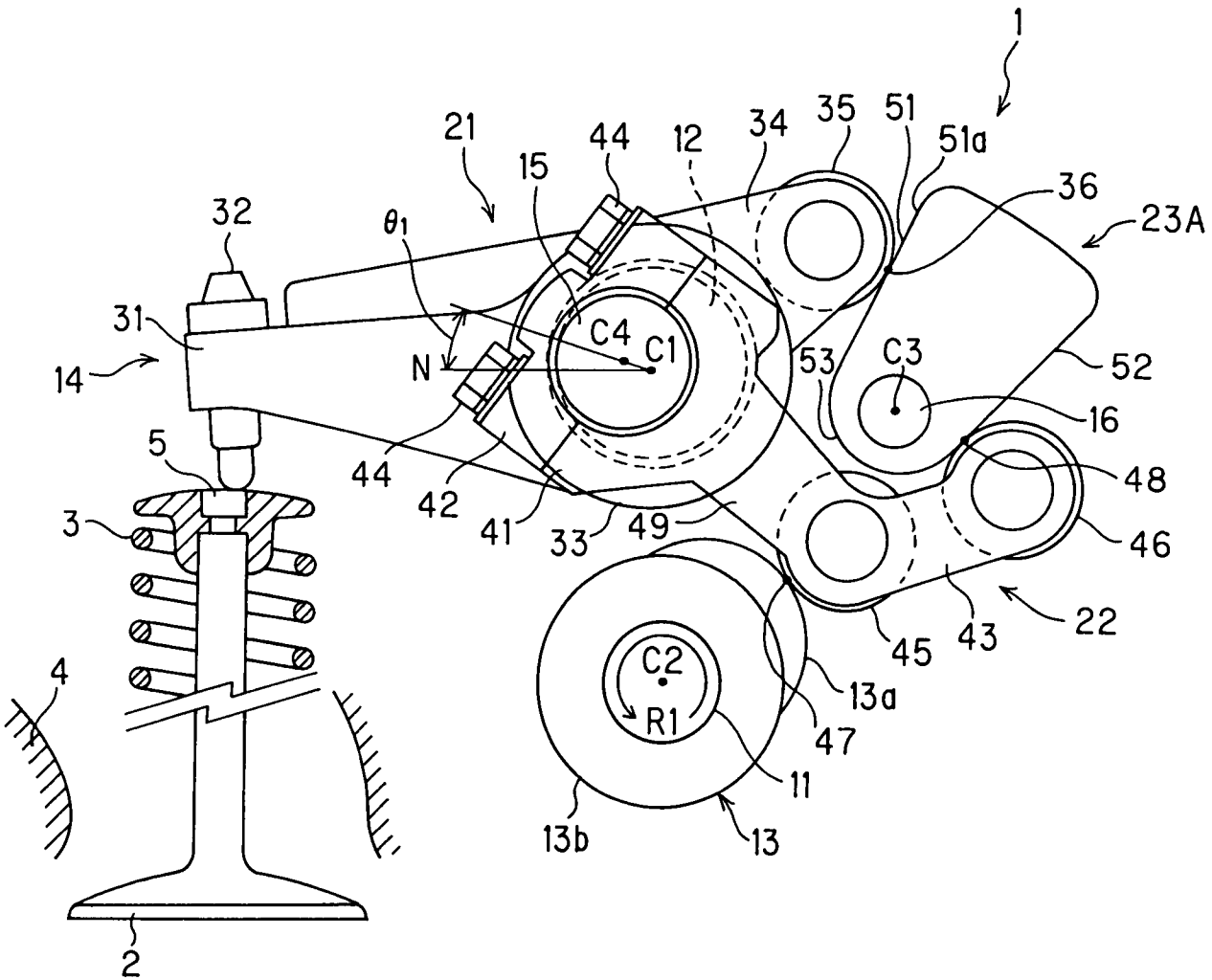
FIG. 3 is a view at the time of valve opening when the phase of the cam angle of the variable valve apparatus shown in FIG. 1 is retarded.
Figure 4:
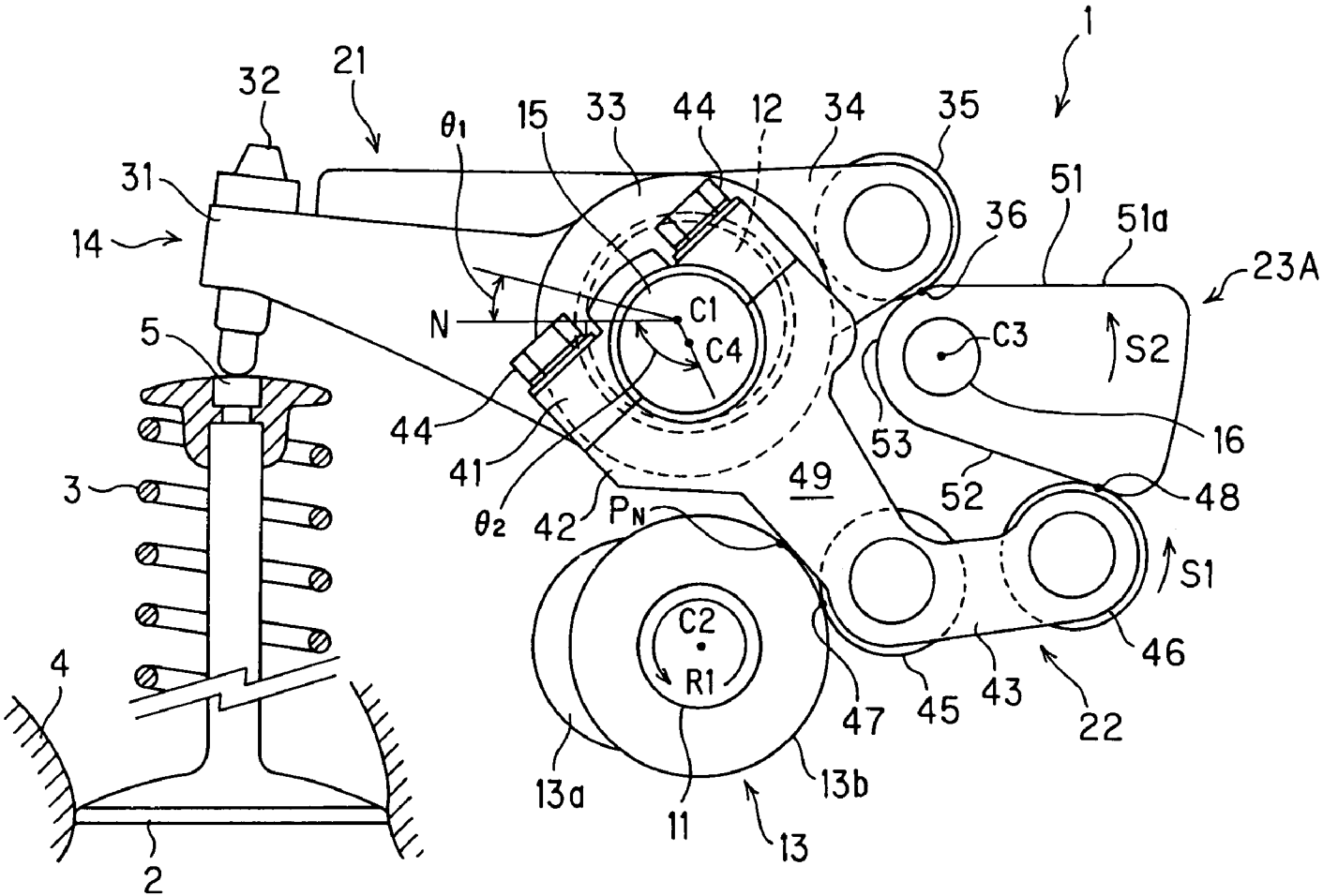
FIG. 4 is a view at the time of valve closing when the phase of the cam angle of the variable valve apparatus shown in FIG. 1 is advanced.
Figure 5:
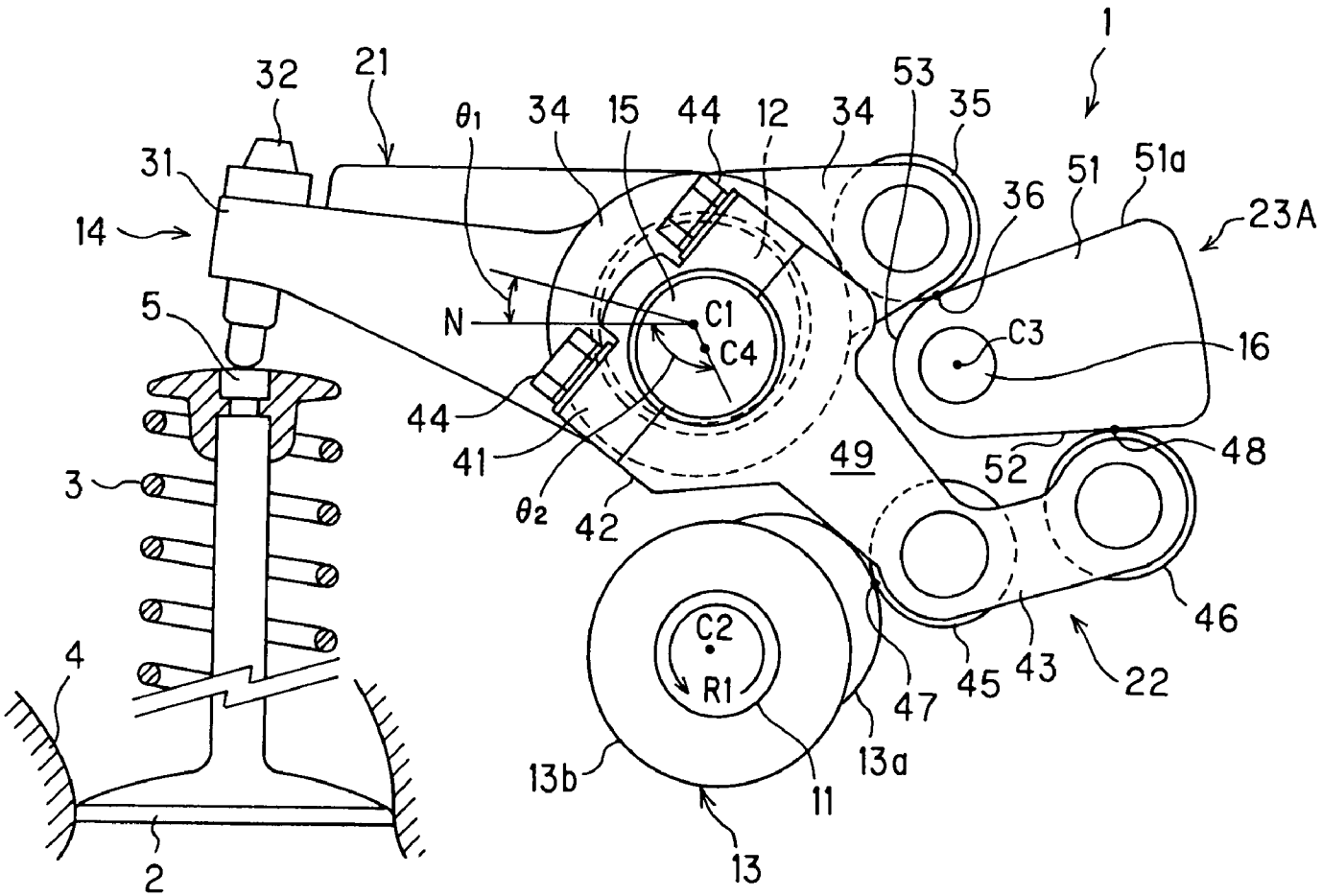
FIG. 5 is a view at a time corresponding to valve opening when the phase of the cam angle of the variable valve apparatus shown in FIG. 1 is advanced.

FIG. 1 is a perspective view of a variable valve apparatus according to the present invention. FIG. 2 shows the status of the variable valve apparatus at the time of valve closing when the phase of a cam angle is at a retard angle. FIG. 3 shows the status of the variable valve apparatus at the time of valve opening when the phase of the cam angle is at a retard angle. FIG. 4 shows the status of the variable valve apparatus at the time of valve closing when the phase of the cam angle is at an advance angle. FIG. 5 shows the status of the variable valve apparatus at a time corresponding to valve opening when the phase of the cam angle is at an advance angle.

A variable valve apparatus 1 according to the present embodiment is disposed, for example, at the site of a cylinder head (not shown) of an internal combustion engine, such as an automobile angle. As shown in FIG. 2, the variable valve apparatus 1 opens or closes an intake valve 2 or the like constituting an air intake system of the internal combustion engine. The intake valve 2 is urged by a valve spring 3 in a direction in which it closes an air intake passage 4. Under the action of the variable valve apparatus 1, the intake valve 2 is pressed downward against the force of the valve spring 3 with a predetermined timing and in a predetermined lift amount to open the air intake passage 4. A similar variable valve apparatus 1 may be provided for an exhaust valve to exercise opening and closing control of the exhaust valve.

The variable valve apparatus 1 has, as main constituents, a camshaft 11 provided rotatably, a rocker shaft 12 provided pivotally, a cam 13 formed on the cam shaft 11, and a rocker arm mechanism 14 (opening and closing elements) driven by the cam 13 rotationally driven by the cam shaft 11. The valve 2 is opened and closed by the drive of the rocker arm mechanism 14.

The cam shaft 11 and the rocker shaft 12 are disposed parallel to each other. The cam shaft 11 is rotated in a direction indicated by an arrow R1 about a center of rotation, C2, of the cam shaft 11 in FIG. 2 in accordance with the rotation of a crankshaft (not shown) of the internal combustion engine.

The rocker shaft 12 can be pivoted, namely, rotated in a reciprocating manner in directions indicated by arrows R2 in FIG. 2 by pivoting elements 24 using a stepping motor or the like. The rocker shaft 12 is provided with an eccentric shaft 15 having a smaller diameter than the diameter of the rocker shaft 12 and having a center of rocking C4 eccentric with respect to the center of rotation C1 of the rocker shaft 12. By so providing the eccentric shaft 15 on the rocker shaft 12, the rocker shaft 12 is formed in a so-called crank structure. In the case of a multi-cylinder engine, one or a plurality of eccentric shafts 15 are provided for each of a plurality of cylinders arranged in the same row. Assume, for example, that the variable valve apparatus of the present embodiment is used for an intake valve of an in-line four-cylinder engine. With a configuration in which there is one intake valve for one cylinder, four eccentric shafts 15 are provided for one rocker shaft 12. With a configuration in which there are two intake valves for one cylinder, eight eccentric shafts 15 are provided for one rocker shaft 12.

When the rocker shaft 12 is rotated in the directions of the arrows R2 by the pivoting elements 24, the eccentric shaft 15, on which a second arm 22 is supported, is displaced in the circumferential direction of the rocker shaft 12 and, accordingly, a point of contact 47 is displaced in the circumferential direction of the cam 13. By this displacement, the rotation phase of the second arm 22 with respect to the cam 13 can be greatly changed toward a retard angle or an advance angle. The rocker shaft 12 has no limits in its rotation angle, and enables a great change in rotation phase to be set.

The rocker arm mechanism 14 has, as main constituents, a first arm 21, the second arm 22, and a third arm 23A.

The first arm 21 has an end portion 31 provided with an adjusting screw 32, and a shaft insertion portion 33 through which the rocker shaft 12 is inserted. Thus, the first arm 21 is supported so as to be capable of relative rotation (rocking) with respect to the rocker shaft 12. The adjusting screw 32 provided at the end portion 31 of the first arm 21 is adjustable to eliminate play between the first arm 21 and the head 5 of the valve 2. A roller 35 is provided in a force transmission portion 34 located on the opposite side of the rocker shaft 12 from the end portion 31 mounted with the adjusting screw 32. The roller 35 functions to transmit the force from the third arm 23A to the first arm 21. Thus, when the cam shaft 11 is rotated in the direction indicated by the arrow R1, the second arm 22, the third arm 23A, and the first arm 21 rock (oscillate) in interlocked relationship with this rotation. Eventually, the front end of the adjusting screw 32 presses down the head 5 of the valve 2, driving the valve 2 in a valve opening direction. The adjusting screw 32 and the roller 35 are appropriately located with respect to the center of rotation C1 of the rocker shaft 12 in accordance with the force exerted on the first arm 21 and the rocking distance.

The second arm 22 has sandwiching portions 41, 42 having concavities of a semicircular section, and is disposed in such a manner as to sandwich the eccentric shaft 15 between these concavities. The sandwiching portions 41 and 42 are fixed to each other by a plurality of bolts 44, whereby the second arm 22 is rockingly supported by the eccentric shaft 15. The second arm 22 also has a roller support portion 43 for rotatably supporting two rollers 45 and 46. The roller 45 rollingly contacts the cam 13 at the point of contact, with the result that the displacement of the outer peripheral shape of the cam 13 in accordance with the rotation of the cam 13 causes the second arm 22 to be rocked about the center of rocking C4 of the eccentric shaft 15. The roller 46 contacts a second cam surface 52 of the third arm 23A, and relays the motion of the second arm 22 rocked by the cam 13 to the third arm 23A. In the present embodiment, the second arm 22 is nearly L-shaped when viewed from its side, having the sandwiching portions 41 and 42 at one end portion, and the roller 46 at the other end portion, and having the roller 45 at an L-shaped bending portion.

The eccentric shaft 15 need not be limited to a disposition as shown in FIG. 1, if its center of rocking C4 is offset (eccentric) with respect to the center of rotation C1 of the rocker shaft 12. If the configuration of the variable valve apparatus 1 is to be rendered compact, however, it is desirable, as in the present embodiment, that the eccentric shaft 15 be smaller in diameter than the rocker shaft 12, and its cross section be internally tangent to the outer diameter of the rocker shaft 12. In this case, the diameter of the eccentric shaft 15 is set in consideration of the rigidity of the entire rocker shaft 12 having the eccentric shaft 15.

In the present embodiment, the eccentric shaft 15 is provided on one side of a support portion of the rocker shaft 12 supporting the first arm 21, a shaft support portion 49 is provided in the second arm 22 to avoid direct interference with the first arm 21, and the eccentric shaft 15 is inserted between the sandwiching portions 41 and 42 on the side of the shaft support portion 49. If load imposed on the second arm 22 is not excessive, the one shaft support portion 49 suffices to mount the second arm 22 on the eccentric shaft 15. Moreover, the axial length of the eccentric shaft 15 may be set appropriately. By so doing, even if offset load occurs at the site of contact between the second arm 22 and the cam 13 and at the site of contact between the second arm 22 and the third arm 23A, the second arm 22 can be prevented from being displaced in the axial direction of the rocker shaft 12, and disadvantages such as partial wear can be prevented, so that the reliability of the variable valve apparatus 1 can be ensured.

If excessive load on the second arm 22 is expected, it is permissible, for example, to form a bifurcated shaft support portion 49 in the second arm 22, and form eccentric shafts 15 on both sides of the support portion where the rocker shaft 12 supports the first arm 21, so that these eccentric shafts 15 are inserted between the fitting portions 41 and 42 of the two shaft support portions 49. This is a configuration in which the bifurcated shaft support portion 49 of the second arm 22 is disposed astride a part of the first arm 21. Because of such a configuration, even if offset load occurs at the site of contact between the second arm 22 and the cam 13 and at the site of contact between the second arm 22 and the third arm 23A, the second arm 22 can be prevented from being displaced in the axial direction of the rocker shaft 12, and disadvantages such as partial wear can be prevented, so that the reliability of the variable valve apparatus 1 can be ensured.

Furthermore, a bifurcated shaft insertion portion 33 for insertion of the rocker shaft 12 may be provide in the first arm 21, the eccentric shaft 15 may be provided between the bifurcations of the bifurcated shaft insertion portion 33 where the first arm 21 is supported by the rocker shaft 12, and the bifurcated shaft insertion portion 33 of the first arm 21 may be disposed astride the one shaft support portion 49 of the second arm 22. By this arrangement, the eccentric shaft 15 may be inserted between the fitting portions 41 and 42 of the shaft support portion 49.

A support shaft 16 is disposed close to the rocker shaft 12, parallel to the rocker shaft 12, and at a height equal to, or at a position lower than, the rocker shaft 12. This disposition of the support shaft 16 limits the height of the variable valve apparatus itself, gives flexibility to the setting of the position of placement of the third arm 23A to be described later, and facilitates the designing of the rocker arm mechanism.

The third arm 23A is rockingly supported by the support shaft 16 and, by being disposed between the roller 35 of the first arm 21 and the roller 46 of the second arm 22, functions as a transmission cam for the first arm 21 and the second arm 22. The third arm 23A is provided with a first cam surface 51 in contact with the roller 35 of the first arm 21, and a second cam surface 52 in contact with the roller 46 of the second arm 22. The third arm 23A is disposed so as to be rocked at a position on the opposite side of the support shaft 16 from the rocker shaft 12. Also, the third arm 23A is urged by a spring (not shown) clockwise about the central position C3 of the support shaft 16, namely, in a direction which the third arm 23A brings the second arm 22 into contact with the cam 13.

The first cam surface 51 functioning as a cam surface is displaced in the rocking direction of the third arm 23A, namely, in the circumferential direction of the support shaft 16, according to the rocking of the second arm 22. Concretely, the first cam surface 51 has a non-conversion surface portion 53 whose distance from the central position C3 of the support shaft 16 does not change upon the rocking of the third arm 23A, and a conversion surface portion 51*a* whose distance from the central position C3 of the support shaft 16 increases upon the rocking of the third arm 23A.

That is, the conversion surface portion 51*a* of the first cam surface 51 is formed in such a planar shape that its distance from the central position C3 of the support shaft 16 changes upon the rocking of the third arm 23A, so as to be able to convert the amount of rocking of the second arm 22, thereby driving the first arm 21. On the other hand, the non-conversion surface portion 53 of the first cam surface 51 is formed in such a surface shape that the amount of rocking of the second arm 22 from its start of rocking until a nearly predetermined angle can be cancelled out even if the rotation phase of the point of contact 47 of the second arm 22 with the cam 13 is brought to a predetermined advance angle by the pivoting elements 24. The reason is that the non-conversion surface portion 53 is formed such that its distance from the central position C3 of the support shaft 16 does not change even upon rocking of the third arm 23A, so that the third arm 23A does not convert the amount of rocking of the second arm 22, and no transmission occurs to the first arm 21.

Thus, the second arm 22 is rocked by a convex portion 13*a* of the cam 13 toward the third arm 23A about the eccentric shaft 15, and the third arm 23A is pivoted counterclockwise via the second cam surface 52. At this time, the first arm 21 is pivoted in the direction of the arrow S3 by the first cam surface 51, whereby the valve 2 is opened. On this occasion, the point of contact 36 between the roller 35 of the first arm 21 and the first cam surface 51 of the third arm 23A moves on the first cam surface 51 in accordance with the rocking of the second arm 22. If the position of the point of contact 36 lies on the non-conversion surface portion 53, the opening of the valve 2 is not performed, and the drive phase for valve opening can be controlled. If the position of the point of contact 36 lies on the conversion surface portion 51*a*, the valve lift amount for valve opening can be controlled in accordance with that position.

The second cam surface 52 also has the same configuration as that of the first cam surface 51; namely, it has a non-conversion surface portion whose distance from the central position C3 of the support shaft 16 does not change even upon the rocking of the third arm 23A, and a conversion surface portion whose distance from the central position C3 of the support shaft 16 increases upon the rocking of the third arm 23A. Thus, depending on the positions of formation of the conversion surface portion 51*a* of the first cam surface and the conversion surface portion of the second cam surface, the optimum amount of lift can be set.

Next, the actions of the variable valve apparatus 1 of the present embodiment will be described with reference to FIGS. 2 and 3.

FIG. 2 shows a state where the rocker shaft 12 is turned toward a retard angle side by an angle $\theta_1$ with respect to a neutral position N by means of the pivoting elements 24. In this case, the second arm 22 contacts the cam 13, with the point of contact 47 being displaced toward a retard angle side (upwardly leftward in FIG. 2) with respect to a neutral point $P_N$. Also, the roller 46 of the second arm 22 is displaced upwardly leftward in FIG. 2.

When, in this state, the cam shaft 11 rotates in the direction of the arrow R1 to push up the roller 45 of the second arm 22 under the action of the convex portion 13*a* of the cam 13, as shown in FIG. 3, the second arm 22 rocks counterclockwise (an arrow S1 of FIG. 2) with the eccentric shaft 15 as an axis of rotation. As a result, the roller 46 of the second arm 22 pushes the second cam surface 52, whereupon the third arm 23A rocks counterclockwise (arrow S2 of FIG. 2). Thus, the conversion surface portion 51*a* of the first cam surface 51 pushes the roller 35, so that the first arm 21 rocks counterclockwise (arrow S3 in FIG. 2). Hence, the front end portion of the adjusting screw 32 pushes down the head 5 to open the valve 2.

In this case, as shown in FIG. 2, the point of contact 36 of the roller 35 of the first arm 21 before valve opening is located toward the conversion surface portion 51*a* of the first cam surface 51 of the third arm 23A. Thus, when the third arm 23A rocks counterclockwise, the non-conversion surface portion 53 become short, and the conversion surface portion 51*a* becomes long, in the first cam surface 51 in contact with the roller 35. Similarly, the point of contact 48 of the roller 46 of the second arm 22 is located toward the conversion surface portion of the second cam surface 52 of the third arm 23A. Thus, when the third arm 23A rocks counterclockwise, the non-conversion surface portion becomes short, and the conversion surface portion becomes long, in the second cam surface 52 in contact with the roller 46.

Figure 6:
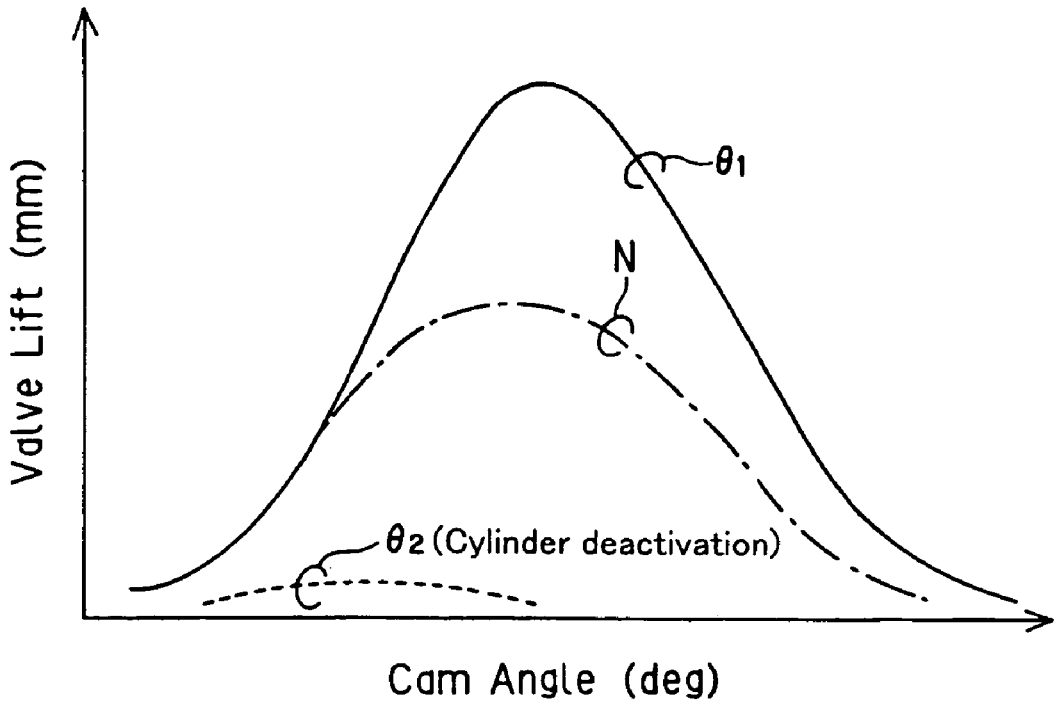
FIG. 6 is a graph showing the relationship between the cam angle and the valve lift amount of the variable valve apparatus shown in FIG. 1.

Hence, while the cam angle is small, the first arm 21 begins to be driven in a direction in which it opens the valve 2, and the first arm 21 is pushed in the direction of the arrow S3 while the roller 35 is contacting the conversion surface portion 51*a* over a long range. Accordingly, a great valve opening angle, namely, a large valve lift amount, is obtained. In this case, as shown in FIG. 6 (see curve $\theta_1$), the valve lift amount is large, and the peak of the valve lift is at a retard angle. This is the drive of the valve suitable for a large intake amount under high engine speed, heavy load conditions. The curve $\theta_1$ in FIG. 6 represents a cam angle-valve lift amount curve when the rocker shaft 12 is brought to a retard angle by $\theta_1$ from the neutral position N.

Next, the actions of the variable valve apparatus 1 of the present embodiment in the state of cylinder deactivation will be described with reference to FIGS. 4 and 5. The state of cylinder deactivation refers to a state in which the valve is not opened, and no fuel is supplied.

FIGS. 4 and 5 show a state where the rocker shaft 12 is turned toward an advance angle side by an angle $\theta_2$ with respect to the neutral position N by means of the pivoting elements 24. In this case, the point of contact 47 of the second arm 22 with the cam 13 is displaced toward an advance angle side (downwardly rightward in FIG. 4) with respect to the neutral point $P_N$. Also, the roller 46 of the second arm 22 is displaced downwardly rightward in FIG. 4, and the third arm 23A is displaced clockwise compared with FIG. 2. In the state of FIG. 4, compared with the state of FIG. 2, the point of contact of the roller 35 before valve opening is located on the non-conversion surface portion 53, so that when the third arm 23A rocks, the roller 35 contacts the non-conversion surface portion 53 alone on the first cam surface 51 of the third arm 23A. That is, the roller 35 of the first arm 21 is out of contact with the conversion surface portion 51*a*.

When, in this state, the cam shaft 11 rotates in the direction of the arrow R1 to push up the roller 45 of the second arm 22 under the action of the convex portion 13*a* of the cam 13, as shown in FIG. 5, the second arm 22 rocks counterclockwise (arrow S1 of FIG. 4) with the eccentric shaft 15 as an axis of rotation. As a result, the roller 46 of the second arm 22 pushes the second cam surface 52, whereupon the third arm 23A rocks counterclockwise (arrow S2 of FIG. 4). At this time, the non-conversion surface portion 53 of the first cam surface 51 contacts the roller 35, so that the arm 21 minimally rocks, producing a state where the valve 2 is not opened, namely, a cylinder deactivation state with the valve lift amount being nearly zero, as indicated by a dashed curve $\theta_2$ in FIG. 6. The curve $\theta_2$ in FIG. 6 represents a cam angle-valve lift amount curve when the rocker shaft 12 is brought to an advance angle by $\theta_2$ from the neutral position N.

When the rocker shaft 12 is turned by the pivoting elements 24 toward an advance angle side at a smaller angle than the angle $\theta_2$ from the neutral position N, the magnitude of the valve lift amount can be controlled appropriately. In this case, the roller 35 of the first arm 21 makes contact, over a long period (distance), with the non-conversion surface portion 53 in the first cam surface 51 of the third arm 23A which functions as a transmission cam. Thus, when the third arm 23A rotates counterclockwise in accordance with the rocking of the second arm 22, the roller 35 moves on the conversion surface portion 51*a* over a short distance. As a result, the pivot amount of the first arm 21 comes to be a valve lift amount smaller than that on the curve $\theta_1$ shown in FIG. 6, namely, a small valve opening angle. At this time, the valve lift amount is small, and the drive phase of the valve is at an advance angle. This is the drive of the valve suitable for a small intake amount under low engine speed, light load conditions.

If the variable valve apparatus 1 of the above-described configuration is applied to an intake system, the opening side of the valve 2 is fixed, while the closing side of the valve can be changed continuously. Thus, a cycle at a high expansion ratio can be provided.

Moreover, fuel economy can be improved by a synergistic effect with inertia intake. Inertial intake refers to air intake within the intake pipe rendered inertial by the pulsation of pressure generated under the intake action of the piston. By use of this inertia intake, the valve 2 begins to be closed at the peak of the intake pulsation, whereby even when the piston is past the bottom dead center, fresh air continues to flow into the cylinder, thus increasing volumetric efficiency. The peak timing of pulsation differs according to the revolution speed of the engine. Thus, the amount of intake air can be increased by starting the closing of the valve 2 in agreement with the peak timing.

With the variable valve apparatus 1 of the present embodiment, if the rocker shaft 12 is turned by the pivoting elements 24 based on the phase, from the start to end of valve opening, and the valve lift amount on the curve $\theta_1$ of FIG. 6, the period during which the second arm 22 has been brought to an advance angle relative to the cam 13 can be cancelled out by lengthening the period of contact between the non-conversion surface portion 53 of the third arm 23A and the roller 35. Consequently, the timing of starting valve opening can be rendered nearly constant as shown by a curve N in FIG. 6 (the cam angle-valve lift amount curve at the neutral position N of the rocker shaft 12).

According to the present variable valve apparatus 1, therefore, the valve closing timing can be changed, with the valve opening start timing being fixed. Thus, the valve closing timing is varied in agreement with the pulsation of inertia intake, whereby the amount of intake air can be increased to reduce fuel consumption. Also, optimum control of the amount of air results in a satisfactory state of combustion, which decreases unburned materials to ameliorate emission gas components.

In the case of a conventional ordinary continuous phase variable valve apparatus, when the valve closing timing of the intake valve is retarded, the valve opening start timing is also retarded. As a result, a valve overlap of the intake valve and the exhaust valve is decreased or lost, thereby causing a pumping loss. According to the variable valve apparatus 1 of the present embodiment, on the other hand, the valve closing timing can be retarded, with the valve opening start timing being fixed. Thus, the valve closing timing is retarded with a valve overlap being kept, whereby the amount of intake air can be increased to improve fuel economy.

Generally, under a light load in the presence of excess air, the exhaust temperature is low. According to the variable valve apparatus 1 of the present embodiment, by contrast, the amount of intake air can be controlled in accordance with the operating state of the engine. Thus, the exhaust gas temperature can be raised by decreasing the amount of intake air under a light load. Consequently, if a catalyst for exhaust gas purification is provided, the catalyst can be activated, and its function can be performed effectively. In this case, emission gases can be purified by the catalyst. Thus, even if emission gas components slightly worsen, the engine main unit can be set in a state of satisfactory fuel economy. By so doing, the fuel economy of the engine main unit can be improved, and the purification of emission gases by the catalyst can achieve both of increased fuel efficiency and emission gas purification. According to the variable valve apparatus 1 of the present embodiment, moreover, the amount of intake air is decreased under a light load, thus obviating the need to provide an intake choke or an exhaust choke for controlling the amount of intake air, thereby realizing cost reduction.

Embodiment 2

Figure 7A:
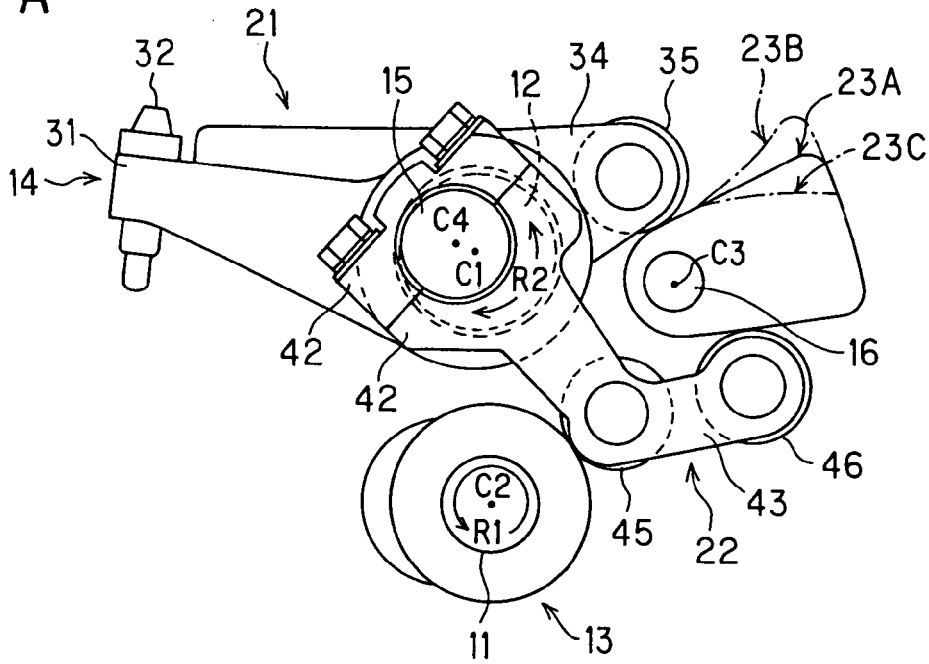
FIGS. 7A to 7C are views showing other examples of the embodiment of the variable valve apparatus according to the present invention.
Figure 7B:
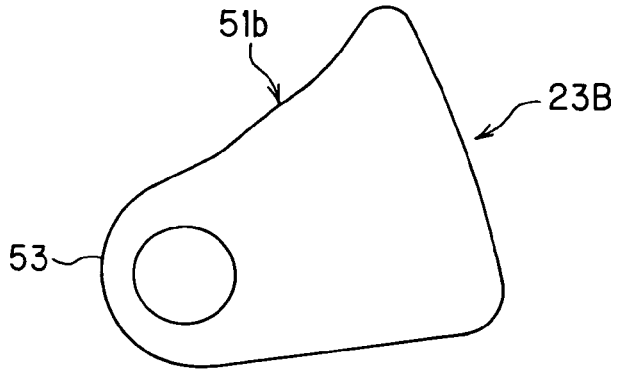
Figure 7C:
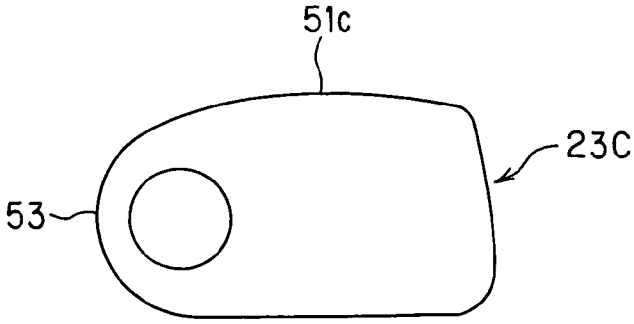

FIGS. 7A to 7C are views showing other examples of the embodiment of the variable valve apparatus according to the present invention.

The variable valve apparatus shown in FIGS. 7A to 7C is different from the aforementioned Embodiment 1 in terms of the configuration of the third arm (see third arm 23A of FIGS. 7A to 7C). Other features, actions and effects are the same as those of the variable valve apparatus 1 of Embodiment 1. Thus, duplicate constituents will be assigned the same numerals as those in Embodiment 1, and detailed explanations will be omitted.

A third arm is located between a roller 35 of a first arm 21 and a roller 46 of a second arm 22 to function as a transmission cam. By appropriately setting the shape of the third arm, especially, the shape of its conversion surface portion, therefore, the magnitude of the lift amount of the valve 2, and further its lift speed, can be appropriately selected. In the case of the variable valve apparatus according to the present invention, in particular, a rotatably supported roller 35 is used in the first arm 21, and a rotatably supported roller 46 is used in the second arm 22, at the sites in contact with the third arm. Thus, the amount of displacement of each arm can be reliably transmitted between the second arm 22 and the third arm 23 and between the third arm 23 and the first arm 21. Moreover, a high degree of flexibility can be provided in setting the shape of the third arm itself. As a result, the entire variable valve apparatus can be rendered compact and, especially, its height can be kept minimum.

Figure 8:
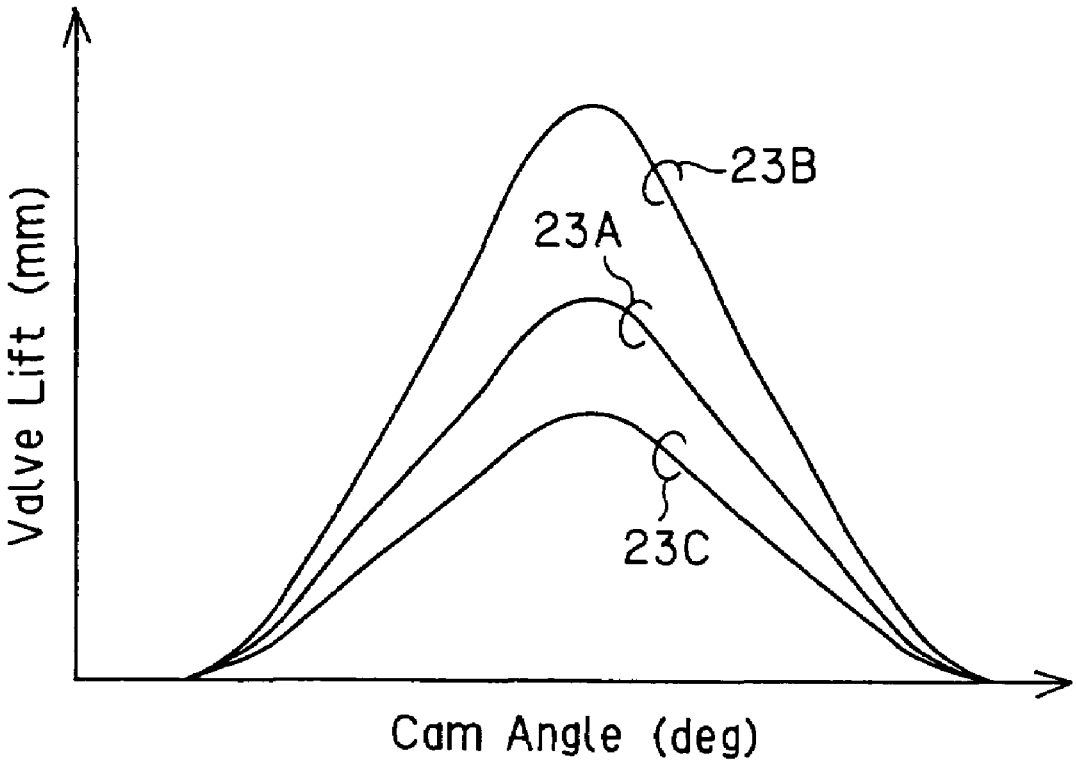
FIG. 8 is a graph showing the relationship between the cam angle and the valve lift amount of the variable valve apparatus shown in FIGS. 7A to 7C.
Figure 9:
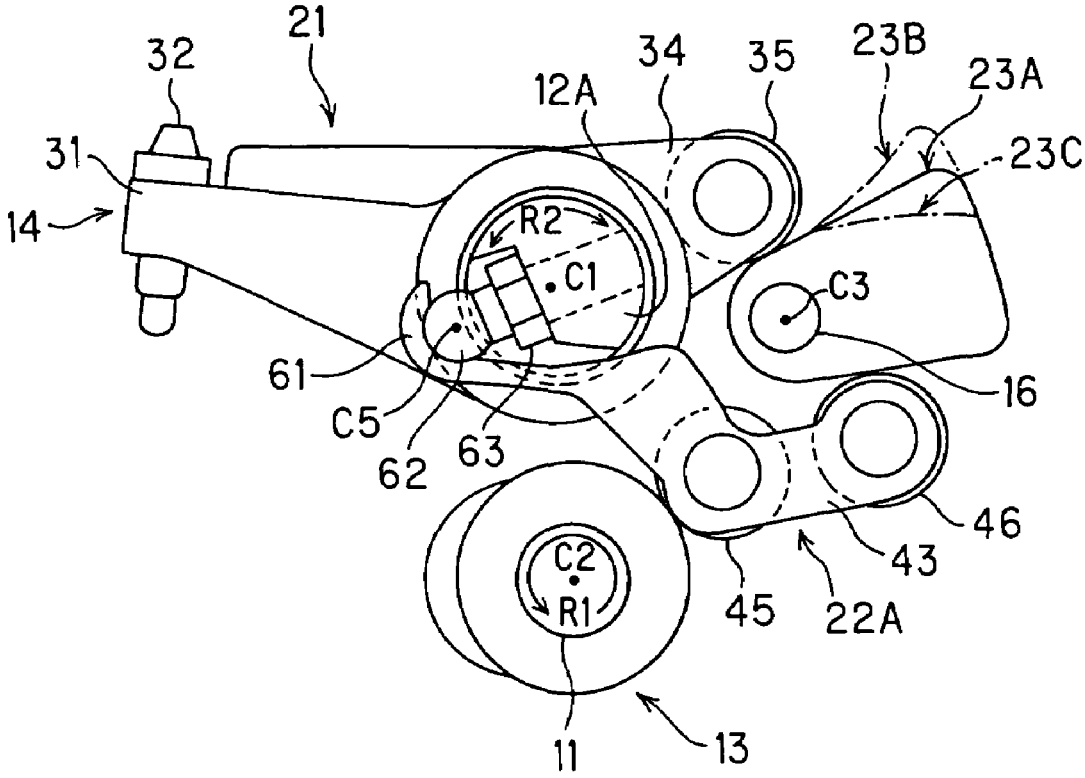
FIG. 9 is a view showing still another example of the embodiment of the variable valve apparatus according to the present invention.

In the third arm 23A of Embodiment 1, for example, the conversion surface portion 51*a* of the first cam surface in contact with the first arm 21 is formed to have a flat surface. In a third arm 23B shown in FIGS. 7A and 7B, on the other hand, a conversion surface portion 51*b* of the first cam surface in contact with the first arm 21 is formed to have a concave curved surface. Because of this shape, according to the rocking of the third arm 23B, the distance of the conversion surface portion 51*b* from the center C3 of a support shaft 16 sharply changes. This feature can set a state in which the speed of opening of the valve 2 is high (rise is great) and the amount of lift is large, as shown by a curve 23B of FIG. 8. FIG. 8 also shows the cam angle-valve lift amount curve when the third arm 23A in Embodiment 1 is used. For comparison, the lift peaks are arranged at the same phase angle.

In a third arm 23C shown in FIGS. 7A and 7C, a conversion surface portion 51*c* of the first cam surface in contact with the first arm 21 is formed to have a convex curved surface. This is a configuration in which according to the rocking of the third arm 23C, the distance of the conversion surface portion 51*c* from the center C3 of the support shaft 16 gently changes. This feature can set a state in which the speed of opening of the valve 2 is low (rise is small) and the amount of lift is small, as shown by a curve 23C of FIG. 8.

As described above, the conversion surface portion of the first cam surface in the third arm, and further the conversion surface portion of the second cam surface in the third arm, are formed in the shape of an appropriate curved surface, as well as a flat surface. By so doing, it becomes easy to set desired valve lift characteristics. It becomes also possible to provide a high degree of flexibility in designing the variable valve apparatus itself. The shape of the curved surface may be not only a simple curved surface such as a convex or concave curved surface as described above, but also a wavy curved surface.

Embodiment 3

The aforementioned Embodiments 1 and 2 show structures in which the second arm 22 is rockingly supported on the rocker shaft 12 via the eccentric shaft 15. However, the present invention is not limited to such a support structure, but may involve a support structure in which a second arm 22A is supported on a rocker shaft 12A with the use of a connecting member 63 having a universal joint 62 which rockingly supports a support portion 61 of the second arm 22A. In the present embodiment, the rocker shaft 12A is partly notched, and the connecting member 63 is disposed in the notched portion for the purpose of connection. The support portion 61 of the second arm 22A is rockingly supported by the universal joint 62 at the head of the connecting member 63, and is rocked about a center of rocking C5. Thus, if the rocker shaft 12A is turned by the pivoting elements 24, the center of rocking C5 is displaced in the circumferential direction of the rocker shaft, and can make the same motion as in Embodiment 1.

While the present invention has been described by the above embodiments, it is to be understood that the invention is not limited thereby, but may be varied or modified in many other ways. Such variations or modifications are not to be regarded as a departure from the spirit and scope of the invention, and all such variations and modifications as would be obvious to one skilled in the art are intended to be included within the scope of the appended claims.

What is claimed is:

1. A variable valve apparatus of an internal combustion engine, comprising:

a rocker shaft pivotally provided in an internal combustion engine, and provided with an eccentric shaft rendered eccentric;

a cam provided below said rocker shaft, and rotationally driven by a cam shaft;

a support shaft disposed at a height equal to or lower than a height of said rocker shaft;

pivoting elements for pivoting said rocker shaft; and opening and closing elements driven by said cam for opening and closing an intake valve or an exhaust valve, and wherein said opening and closing elements comprises a first arm rockingly supported by said rocker shaft, and being capable of driving said intake valve or said exhaust valve, a second arm rockingly supported by said eccentric shaft, and driven by said cam, and a third arm rockingly supported by said support shaft, and displaced by rocking of said second arm for driving said first arm.

2. The variable valve apparatus of an internal combustion engine according to claim 1, wherein said eccentric shaft is displaced in a circumferential direction of said rocker shaft by pivoting of said rocker shaft by said pivoting elements.

3. The variable valve apparatus of an internal combustion engine according to claim 2, wherein said third arm has a first cam surface in contact with said first arm, and a second cam surface in contact with said second arm, and said first cam surface and said second cam surface are rocked in contact with said first arm and said second arm at a position on an opposite side of said support shaft from said rocker shaft.

4. The variable valve apparatus of an internal combustion engine according to claim 3, wherein rollers are provided in said first arm and said second arm, and said rollers are brought into contact with said first cam surface and said second cam surface of said third arm.

5. The variable valve apparatus of an internal combustion engine according to claim 4, wherein said first cam surface and said second cam surface have a conversion surface portion whose distance from a center of said support shaft changes, and said conversion surface portion is composed of a flat surface.

6. The variable valve apparatus of an internal combustion engine according to claim 4, wherein said first cam surface and said second cam surface have a conversion surface portion whose distance from a center of said support shaft changes, and said conversion surface portion is composed of a convex curved surface or a concave curved surface.

7. The variable valve apparatus of an internal combustion engine according to claim 5, wherein said first cam surface and said second cam surface have a non-conversion surface portion whose distance from the center of said support shaft does not change in a direction of rocking of said third arm.

8. The variable valve apparatus of an internal combustion engine according to claim 6, wherein said first cam surface and said second cam surface have a non-conversion surface portion whose distance from the center of said support shaft does not change in a direction of rocking of said third arm.

9. A variable valve apparatus of an internal combustion engine, comprising:

a rocker shaft pivotally provided in an internal combustion engine;

a cam provided below said rocker shaft, and rotationally driven by a cam shaft;

a support shaft disposed at a height equal to or lower than a height of said rocker shaft;

pivoting elements for pivoting said rocker shaft; and opening and closing elements driven by said cam for opening and closing an intake valve or an exhaust valve, and wherein said opening and closing elements comprises a first arm rockingly supported by said rocker shaft, and being capable of driving said intake valve or said exhaust valve, a second arm rockingly supported by a connecting member provided in said rocker shaft, and driven by said cam, and a third arm rockingly supported by said support shaft, and displaced by rocking of said second arm for driving said first arm.

10. The variable valve apparatus of an internal combustion engine according to claim 9, wherein said connecting member is displaced in a circumferential direction of said rocker shaft in accordance with pivoting of said rocker shaft by said pivoting elements.

11. The variable valve apparatus of an internal combustion engine according to claim 10, wherein said third arm has a first cam surface in contact with said first arm, and a second cam surface in contact with said second arm, and said first cam surface and said second cam surface are rocked in contact with said first arm and said second arm at a position on an opposite side of said support shaft from said rocker shaft.

12. The variable valve apparatus of an internal combustion engine according to claim 11, wherein rollers are provided in said first arm and said second arm, and said rollers are brought into contact with said first cam surface and said second cam surface of said third arm.

13. The variable valve apparatus of an internal combustion engine according to claim 12, wherein said first cam surface and said second cam surface have a conversion surface portion whose distance from a center of said support shaft changes, and said conversion surface portion is composed of a flat surface.

14. The variable valve apparatus of an internal combustion engine according to claim 12, wherein said first cam surface and said second cam surface have a conversion surface portion whose distance from a center of said support shaft changes, and said conversion surface portion is composed of a convex curved surface or a concave curved surface.

15. The variable valve apparatus of an internal combustion engine according to claim 13, wherein said first cam surface and said second cam surface have a non-conversion surface portion whose distance from the center of said support shaft does not change in a direction of rocking of said third arm.

16. The variable valve apparatus of an internal combustion engine according to claim 14, wherein said first cam surface and said second cam surface have a non-conversion surface portion whose distance from the center of said support shaft does not change in a direction of rocking of said third arm.

* * * * *